United States Patent [19]

Bradshaw

[11] 3,941,342

[45] Mar. 2, 1976

[54] ADJUSTABLE SOAKER HOSE SUPPORT ASSEMBLY

[76] Inventor: Kenneth E. Bradshaw, 5101 W. Kent St., Santa Ana, Calif. 92704

[22] Filed: Jan. 28, 1975

[21] Appl. No.: 544,790

[52] U.S. Cl. ..... 248/88; 239/276; 248/87

[51] Int. Cl.[2] ..... B05B 15/06

[58] Field of Search ..... 248/75, 80–88; 239/273, 275, 280, 280.5, 276

[56] References Cited

UNITED STATES PATENTS

| | | | |
|---|---|---|---|
| 414,881 | 11/1889 | Grams | 248/88 |
| 755,995 | 3/1904 | Brown | 248/86 |
| 925,680 | 6/1909 | Burns | 248/86 |
| 994,455 | 6/1911 | Glover et al. | 248/84 |
| 2,993,671 | 7/1961 | Knebusch | 248/87 |
| 3,301,515 | 1/1967 | Gerbracht | 248/87 |
| 3,334,852 | 8/1967 | Sumida et al. | 248/83 |
| 3,488,068 | 1/1970 | De Voe | 248/88 X |
| 3,588,012 | 6/1971 | Schaefer | 248/87 X |
| 3,599,917 | 8/1971 | Schwartz | 248/87 |
| 3,638,863 | 2/1972 | Roberts | 248/87 X |

*Primary Examiner*—Roy D. Frazier
*Assistant Examiner*—Rodney H. Bonck

[57] ABSTRACT

Adjustable soaker hose support assemblies that are driven or forced into the earth in spaced relationship adjacent an area that is to be watered. When the assemblies are so disposed a soaker hose having a number of longitudinally spaced water discharge openings therein is removably secured to the assemblies. The assemblies so support the soaker hose, that both the hose and discharge openings therein may be manually adjusted to permit a first desired area of the earth to be watered and then subsequently other areas likewise watered, upon completion of the watering operation the soaker hose is easily separated from the assemblies, and the assemblies pulled from the earth and stored with the soaker hose until again needed. The assemblies are preferably formed by conventional molding operations from a high impact polymercized resin. The assemblies are of such structure that they may be easily supported in hard packed earth by being driven therein by hammer blows applied to the tops of the assemblies.

4 Claims, 12 Drawing Figures

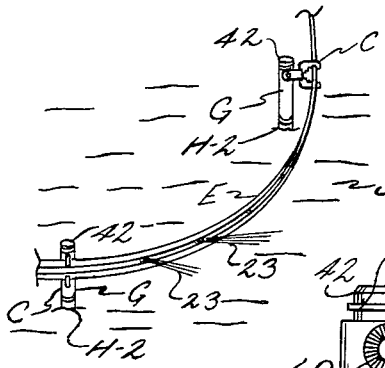
FIG. 1
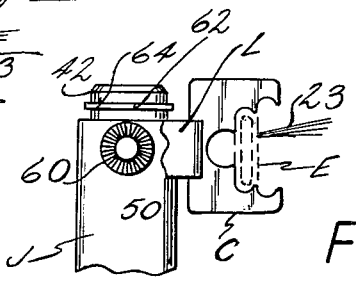
FIG. 6
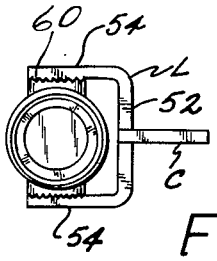
FIG. 7
FIG. 4
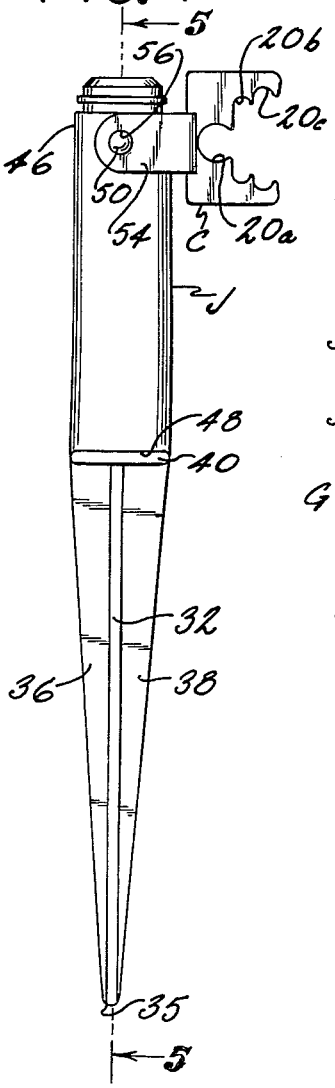
FIG. 5
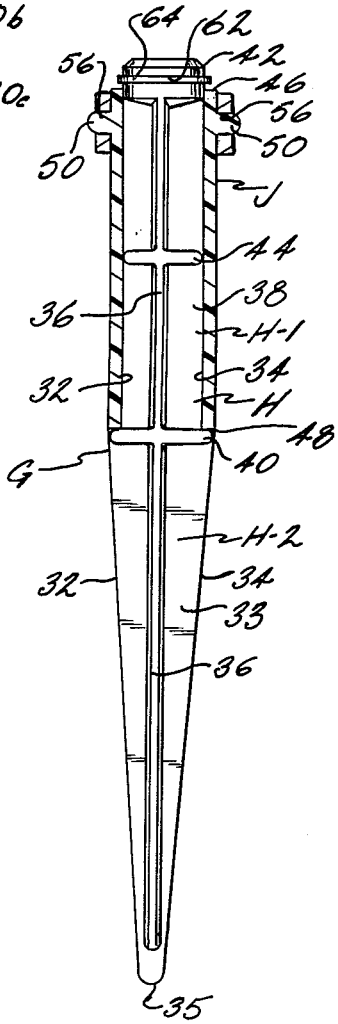
FIG. 2
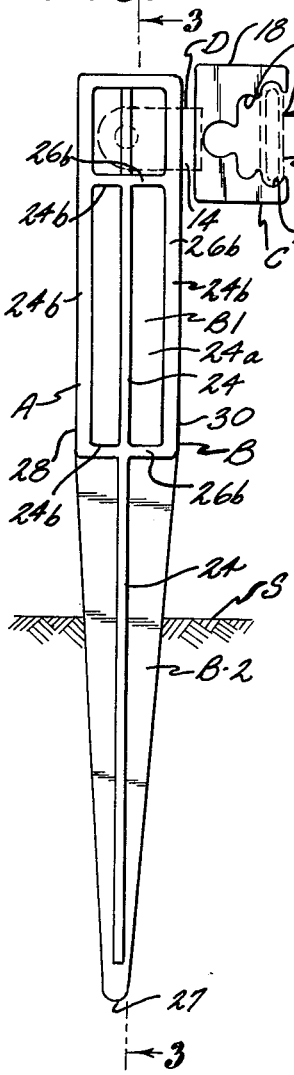
FIG. 3
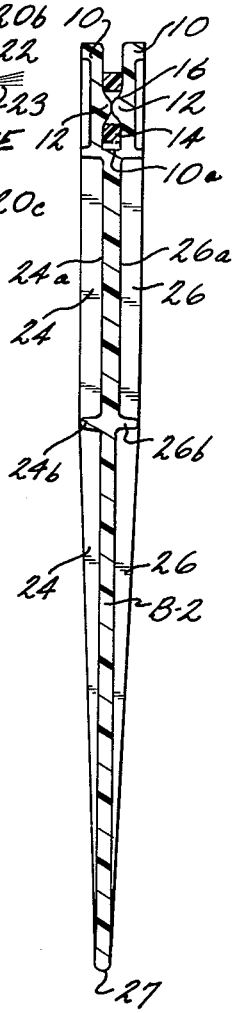

ADJUSTABLE SOAKER HOSE SUPPORT ASSEMBLY

BACKGROUND OF THE INVENTION

1. Field of the Invention

Adjustable Soaker Hose Support Assembly.

2. Description of the Prior Art

For many years soaker hoses that have an elongate transverse cross section of narrow width, and with a number of longitudinally spaced water discharge openings therein from which fine jets of water flow, have been used in the watering of desired areas of the earth, a major problem in the use of such soaker hoses, particularly in rolling or inclined areas, is to maintain the hose in such relationship to the earth surface that a desired area of the latter is watered.

The primary object in devising the present invention is to supply a number of assemblies that are driven into the ground in desired spaced relationship adjacent the area to be watered, with the assemblies thereafter having the soaker hose removably mounted thereon, and the hose after being so mounted being manually adjustable to direct water from the discharge openings onto a particular area to be watered.

Another object of the invention is to supply assemblies capable of removably holding soaker hoses of various widths thereon to permit first one area of the earth to be watered, and then by manual adjustment of the assemblies changing the angular relationship of the hose and discharge openings relative to the earth surface to allow other areas of the latter to be watered.

A still further object of the invention is to provide soaker hose support assemblies that are simple and easy to use, are of simple mechanical structure, are susceptible to being injection molded from a high impact polymercized resin, may be driven by a hammer into hard compacted earth, require little or no maintenance attention, and will not corrode or discolor even after prolonged usage.

SUMMARY OF THE INVENTION

In a first form of the invention an elongate rigid member is provided that has first and second portions, with the second portion having a pointed free end to permit the member to be hammered or forced into the earth. Each member has support means operatively associated therewith that is capable of removably engaging soaker hose of first, second and third widths. Each support means is by first means pivotally supported from the first portion of the member to permit the soaker hose to be selectively positioned on opposite sides of the member.

In a second form of the invention the first means is of such structure that the supporting means may be not only pivoted to opposite sides of the member but to intermediate positions therebetween, and the second form further including means for holding the supporting means in the position to which it is adjusted. The second form is of such structure that not only is the supporting means transversely adjustable relative to the elongate member, but is rotatably adjustable thereto.

BRIEF DESCRIPTION OF THE DRAWINGS

FIG. 1 is a perspective view of two of the adjustable soaker hose support assemblies disposed in driven positions in the earth, and removably supporting a section of soaker hose therebetween in a desired angular position relative to the earth's surface;

FIG. 2 is a side elevational view of a first form of the invention;

FIG. 3 is a longitudinal cross-sectional view of the first form of the invention taken on the line 3—3 of FIG. 2;

FIG. 4 is a side elevational view of a second form of the invention;

FIG. 5 is a longitudinal cross-sectional view of the second form of the invention taken on the line 5—5 of FIG. 4;

FIG. 6 is a fragmentary side elevational view of the upper portion of the second form of the invention with a bail partially broken away to disclose a serrated surface formed on the rotatable shell;

FIG. 7 is a top plan view of a second form of the invention illustrating the top surface that may be utilized to hammer the second form of the invention into the earth, in this view also showing the serrated surfaces that cooperate to hold the bail and the soaker support in a desired angular position relative to the ground surface;

DESCRIPTION OF THE PREFERRED EMBODIMENT

Figure 8:
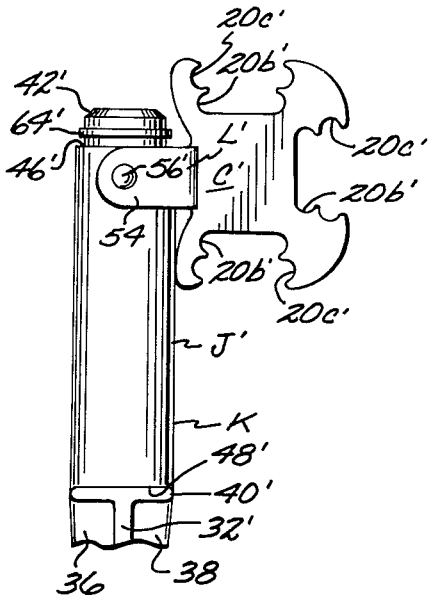
FIG. 8 is a side elevational view of a third form of the invention.

The first form A of the adjustable soaker hose support assembly as may best be seen in FIGS. 2 and 3 include an elongate member B, that is preferably injection molded from a high impact polymerized resin. The elongate member B includes a first upper portion B-1 and a second lower portion B-2 that may be driven or forced into the earth's surface to support a soaker hose E at a desired location thereon. Support means C are provided for removably engaging a transverse segment of the soaker hose E which is shown in phantom line in FIG. 2. The support means C is pivotally mounted by first means D from the upper portion of the elongate member B as illustrated in FIGS. 2 and 3.

The first portion B-1 of elongate member B has a bifurcated upper end 10 that has two protuberances 12 extending inwardly towards one another. The protuberances 12 pivotally engage an aperture 16 formed in a first plate 14, which plate is pivotally movable relative to the elongate member B, and is a specific form of the first means D. A second plate 18 is secured to or is formed as a part of the first plate 14, with the second plate having first, second and third connected elongate recesses **20*a*, 20*b*, and 20*c* therein, which recesses vary in length to removably support soaker hoses E of various widths and this plate being a specific form of the support means C. The soaker hose E is formed with longitudinally spaced water discharge openings 22 therein through which fine jets of water 23** are discharged onto the desired areas of the earth surface S.

The elongate member B has first and second ribs 24 and 26 that extend substantially the length thereof and project outwardly from first surfaces **24*a* and 26*a*. The first surfaces 24***a* and 26*a* are oppositely disposed from one another and extend between first and second longitudinal edges 28 and 30 of the elongate member B. The lower portion B-2 as may best be seen in FIG. 2 terminates in a pointed lower end 27 to permit the first form A of the invention to be forced into the earth surface S either by pushing, or in the event that the earth surface is hard by tapping on the upper end of the first portion B-1. The first portion B-1 may be longitudinally reinforced by outwardly projecting first and second ribs 24*b* and 26*b* arranged in a box-like configuration as shown in FIGS. 2 and 3.

The first form A of the unit is used by forcing the second portion B-2 downwardly a substantial distance below the earth surface S as shown in FIG. 2, with the soaker hose E then being removably inserted in an appropriate one of the first, second or third recesses 20*a*, 20*b*, or 20*c*. In FIG. 2 it will be seen that the soaker hose E is illustrated as such width that it is snuggly but removably retained within the third recess 20*c*. The support C for the soaker hose E may be either disposed in the position shown in FIG. 2, or pivoted transversely to occupy a like position on an opposite side of the elongate member B. The lower portion of the bifurcated end 10 provides a stop 10a that limits the downward pivotal movement of the soaker hose support C below the position shown in FIG. 2, irrespective of which side of the elongate member B the soaker hose support C is situated on. After the first form A of the invention has served its intended purpose, the soaker hose E may be removed therefrom, and the first form A of the invention withdrawn from the ground surface and stored until further watering of a desired area of the earth's surface S is required.

The second form G of the invention is best seen in FIGS. 1 and 4 to 7 inclusive, include an elongate member H, an upper portion H-1, and a lower second portion H-2. Elongate member H has first and second longitudinally extending edges 32 and 34 between which oppositely disposed side surfaces 33 extend. The lower end of the second lower portion H-2 in FIGS. 4 and 5 terminate in a pointed lower end 35. First and second elongate ribs 36 and 38 project outwarldy from the side surfaces 33, with the first and second ribs being of such depth that the transverse cross section of the member H at any particular longitudinal position thereon is generally that of a cross having legs of equal length. At the junction between the first and second portions H-1 and H-2, a transverse stop 40 is formed as an integral part of member H as best seen in FIGS. 4 and 5. The upper free end of the first portion H-1 is defined by a cylindrical head 42, and the first portion H-1 intermediate the head 42 and stops 40 having a transverse circular guide plate 44 formed as a part thereof.

A cylindrical shell J is provided that has first and second free end edges 46 and 48. The second end 48 of shell J is rotatably supported on stop 40 as best seen in FIG. 5. Two oppositely disposed pins 50 project outwardly from the upper external portion of shell J adjacent the first end 46 thereof. A soaker hose support C that may be identical to the one previously described is secured to a transverse web 52 of a bail L. The bail L includes two parallel laterally spaced legs 54 secured to the web 52. The bail L is formed from a resilient material. The bail L has two transverse, axially aligned openings 56 therein that pivotally engage the pins 50. The shell J adjacent pins 50 has two oppositely flat serrated surfaces 60 defined thereon that frictionally engage serrated surfaces 60 formed on the interior of the legs 54 adjacent the openings 56 therein. The serrated surfaces 60 cooperate with the resiliency of the material defining bail L to permit the bail and support C secured thereto to be disposed on either side of shell J or a position intermediate therebetween.

The head 42, as best seen in FIGS. 4 and 5 has a circumferential groove 62 formed therein that is engaged by a snap ring 64, which snap ring serves to prevent the shell J being inadvertently displaced from the member H.

The use of the second form G of the invention is substantially the same as that of the first form, other than the second form G is more adapted to being forced into a ground surface S that is hard or compacted, as the upper surface of the head 64 may be hammered without danger of the shock being transferred to the shell J.

The third form K of the invention shown in FIG. 8 is similar to that shown in FIGS. 4–7 but provides a soaker hose support C′ including three sets of hose receiving recesses 20*b*′, 20*c*′ which serve the same functions as the previously described recesses 20*b* and 20*c*.

Figure 9:
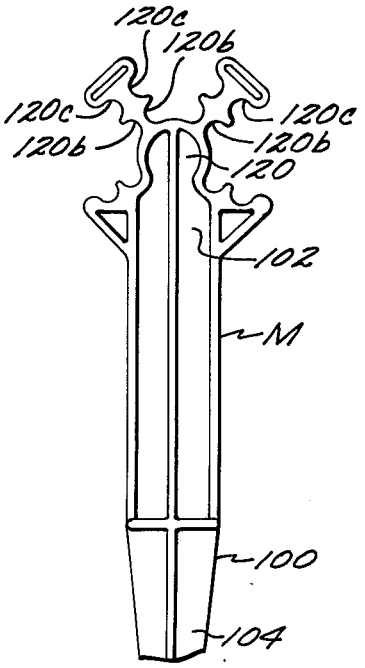
FIG. 9 is a side elevational view of a fourth form of the invention.
Figure 10:
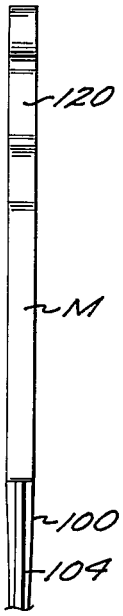
FIG. 10 is an end elevational view of the form of the invention shown in FIG. 9.

The fourth form M of the invention shown in FIGS. 9 and 10 includes an elongate member 100 having a first end portion 102 and a longitudinally extending portion 104 of tapered configuration that terminates in a point (not shown). First end portion 102 has a plate 120 extending therefrom in which three sets of recesses 120*b* and 120*c* are defined that serve the same functions as the previously described recesses 20*b* and 20*c*.

Figure 11:
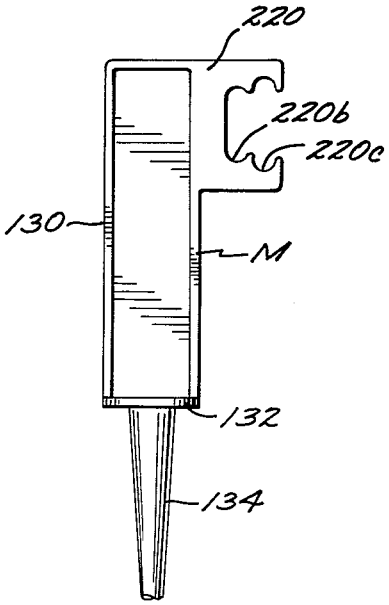
FIG. 11 is a side elevational view of a fifth form of the invention.
Figure 12:
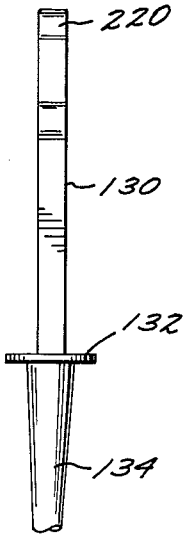
FIG. 12 is an end elevational view of the invention shown in FIG. 11.

A fifth form M is shown in FIGS. 11 and 12 that includes a first upper end portion 130 that at the lower end terminates in a plate 132 that has a tapered member 134 of circular transverse cross section extending therefrom. First end portion has a soaker hose support 220 extending therefrom in which soaker hose supporting recesses 220*b* and 220*c* are formed that serve the same function as the previously described recesses 20*b* and 20*c*. The support 220 serves a dual function, first to removably hold the soaker hose E, and second, as a handle which a user grasps together with first end portion 130 to force the fifth form M of the invention downwardly into the ground with a twisting motion. The support 220 permits easy withdrawal of the fifth form M from the ground when no longer needed.

The use and operation of the invention has been described previously in detail and need not be repeated.

I claim:

1. In combination with a soaker hose having a plurality of longitudinally spaced water discharge openings therein, a plurality of support assemblies that may removably engage said hose to selectively hold the latter at any desired one of a plurality of possible positions relative to the earth surface when said support assemblies are partially embedded in the ground, each of said support assemblies including:

a. an elongate member having first and second longitudinal sides and that has a first upwardly disposable end portion and a second downwardly disposable portion, said second downwardly disposable portion tapering longitudinally and terminating in a generally pointed free end, and said member formed from a polymerized resin of sufficient strength that said second downwardly disposable portion may be at least partially embedded in the soil when a longitudinally directed force is applied to said first upwardly disposable end portion;

b. support means that can removably and transversely engage a segment of said soaker hose;

c. first means connected to said support means and pivotally secured to said upper portion to permit said soaker hose to be disposed at any desired one of a plurality of possible positions relative to said earth surface to permit water from said discharge openings to be directed onto a plurality of areas of said earth surface, said first means including:

1. a bail secured to said support means and extending outwardly therefrom, said bail having a pair of oppositely disposed co-axially aligned openings therein, said bail formed from a resilient material;
2. a cylindrical shell having first and second ends;
3. a pair of pins that extend outwardly from said shell and pivotally engage said pair of openings, with said bail and shell having contacting surfaces, and said contacting surfaces having serrations defined thereon that pressure interlock to hold said bail and support means at the angle on said shell to which said bail is adjusted;
4. a stop that extends outwardly from said member at substantially the junction of said first upwardly disposable end portion and said second downwardly disposable portion, said stop rotatably engaged by said first end of said shell;

5. a cylindrical head on said first upwardly disposable end portion of said member, said head rotatably engaing the interior surface of said shell adjacent said second end thereof, said head having a circumferential groove therein, and said head of sufficient strength to receive hammer blows to drive said second portion of said support assembly into the earth; and
6. a snap ring that removably engages said groove to prevent said shell from being inadvertently displaced from said first portion of said member.

2. A support assembly as defined in claim 1 which in addition includes:

d. a circular guide plate that extends transversely from said first upwardly disposable end portion of said member intermediate said stop and said head, said guide plate being rotatably engaged by the interior surface of said shell, and said guide plate and head cooperating to maintain said shell in an axially aligned position on said first upwardly disposable end portion of said member.

3. A support assembly as defined in claim 1 in which said soaker hose is flat and may be of either a first or second width, and said support means is a plate that extends outwardly from said bail, with said plate having first and second connected recesses therein that may removably engage said soaker hose of said first or second widths.

4. A support assembly as defined in claim 3 in which said plate is an integral part of said bail.

* * * * *